US009142904B2

(12) United States Patent
Martin et al.

(10) Patent No.: US 9,142,904 B2
(45) Date of Patent: Sep. 22, 2015

(54) ELECTRICAL CONNECTOR WITH TERMINAL POSITION ASSURANCE

(71) Applicant: Tyco Electronics Corporation, Berwyn, PA (US)

(72) Inventors: Galen M. Martin, Camp Hill, PA (US); John Raymond Shuey, Mechanicsburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 81 days.

(21) Appl. No.: 14/155,149

(22) Filed: Jan. 14, 2014

(65) Prior Publication Data

US 2015/0200483 A1 Jul. 16, 2015

(51) Int. Cl.

| | |
|---|---|
| ***H01R 13/40*** | (2006.01) |
| ***H01R 13/424*** | (2006.01) |
| ***H01R 24/20*** | (2011.01) |
| ***H01R 13/64*** | (2006.01) |

(52) U.S. Cl.

CPC ..... *H01R 13/424* (2013.01); *H01R 13/40* (2013.01); *H01R 13/64* (2013.01); *H01R 24/20* (2013.01)

(58) Field of Classification Search

USPC ..... 439/595, 489, 157, 752, 603, 594, 836, 439/857

See application file for complete search history.

(56) References Cited

U.S. PATENT DOCUMENTS

| | | | | |
|---|---|---|---|---|
| 5,151,048 | A * | 9/1992 | Sato | 439/357 |
| 6,461,186 | B1 * | 10/2002 | Endo | 439/352 |
| 6,767,239 | B2 * | 7/2004 | Fukamachi | 439/378 |
| 7,066,773 | B1 | 6/2006 | Martin | |
| 7,347,732 | B2 * | 3/2008 | Ohtaka et al. | 439/595 |
| 8,147,279 | B1 | 4/2012 | Martin et al. | |
| 8,430,689 | B2 | 4/2013 | Myer et al. | |
| 2008/0020639 | A1 * | 1/2008 | Ichio | 439/595 |
| 2012/0270433 | A1 | 10/2012 | Myer et al. | |

FOREIGN PATENT DOCUMENTS

JP 10-74561 * 8/1996

* cited by examiner

*Primary Examiner* — Abdullah Riyami
*Assistant Examiner* — Harshad Patel

(57) ABSTRACT

An electrical connector is provided that includes a housing that has a mating end and a carrier receiving end. The housing includes a rail that extends through the carrier receiving end into a chamber defined by the housing. The electrical connector also includes a carrier configured to be loaded into the chamber from the carrier receiving end. The carrier has terminal channels that are configured to receive terminals therein, and retention latches configured to retain the terminals in the terminal channels. The carrier also has a groove that is configured to receive the rail of the housing when the carrier is loaded within the housing. When a terminal is not fully inserted within a terminal channel, the retention latch in the terminal channel is deflected outward into the groove. The retention latch interferes with the rail of the housing and prevents further advancement of the carrier into the chamber.

20 Claims, 5 Drawing Sheets

ELECTRICAL CONNECTOR WITH TERMINAL POSITION ASSURANCE

BACKGROUND OF THE INVENTION

The subject matter herein relates generally to electrical connectors having terminal position assurance.

Electrical connectors may be carrier-style electrical connectors that typically include a carrier that receives terminals of a wire harness, and a housing that receives the carrier. Carrier-style electrical connectors may be used in harsh environments, such as automotive applications, in which the electrical connectors are subject to vibration and other forces that may tend to alter the position of the terminals relative to the connector.

In various applications of electrical connectors, devices are utilized to lock terminals in place within the connector and to assure that the terminals are in proper position within the connector, even when exposed to vibration and other harsh conditions. Typical carrier-style electrical connectors are designed for use with terminals having a metal locking lance or terminals that have two locking surfaces, with one for primary latching and another one for secondary latching. These designs exclude many types of terminals for use in carrier-style electrical connectors.

Certain electrical connectors include one or more terminal position assurance (TPA) elements. The TPA assures the terminal contacts are in proper position for electrically mating with mating contacts of a mating connector. For example, the TPA element may not allow the carrier to move to a final loaded position within the housing until a terminal is fully loaded in the carrier. In addition, the TPA element may be designed to hinder or block unintentional withdrawal of the terminals. In many connector designs, the TPA element is a separate, external device that locks onto the connector. The TPA element is entirely removable from the connector, and this aspect may, over time, compromise the integrity of the connector.

A need remains for a carrier style electrical connector having reliable primary latch reinforcement and assures proper terminal position within the electrical connector.

BRIEF DESCRIPTION OF THE INVENTION

In an exemplary embodiment, an electrical connector includes a housing having a mating end and a carrier receiving end. The housing includes a rail that extends from the carrier receiving end into a chamber defined by the housing. A carrier is configured to be loaded into the chamber through the carrier receiving end. The carrier has terminal channels spaced along a width that are configured to receive terminals therein. The carrier has retention latches within the terminal channels that are configured to retain the terminals in the terminal channels. The carrier also has a groove extending along the width of the carrier that is configured to receive the rail of the housing when the carrier is loaded within the housing. When one of the terminals is not fully inserted within one of the terminal channels, the corresponding retention latch in the terminal channel is deflected outward at least partially into the groove such that the retention latch interferes with the rail of the housing and prevents further advancement of the carrier into the chamber.

In an exemplary embodiment, an electrical connector includes a carrier having terminal channels spaced along a width of the carrier and a track on an outer surface of the carrier that extends along the width. The terminal channels are configured to receive terminals therein for connecting to mating contacts of a mating connector. The carrier includes retention beams mounted inward of the outer surface and extending into the terminal channels. A housing receives and at least partially surrounds the carrier. The housing includes a rail that is received in the track of the carrier when the carrier is loaded into the housing. Until a terminal that is being inserted into a corresponding terminal channel reaches a fully loaded position within the terminal channel, the terminal deflects the corresponding retention beam in the terminal channel outward at least partially into the track. The retention beam interferes with the rail of the housing and prevents further advancement of the carrier into the housing beyond the retention beam.

In an exemplary embodiment, an electrical connector includes a housing having a mating end configured to interface with a mating connector and a carrier receiving end adjacent to the mating end. The housing includes a rail protruding from an inner wall and extending from the carrier receiving end into a chamber defined by the housing. A carrier has a front and a rear and defines multiple terminal channels between the front and the rear that are oriented along parallel terminal channel axes. The terminal channels are configured to receive terminals therein. The carrier has retention latches configured to retain the terminals in the terminal channels. The carrier is configured to be loaded into the chamber of the housing through the carrier receiving end in a loading direction that is perpendicular to the terminal channel axes such that the front of the carrier is proximate to the mating end of the housing. The carrier includes a groove extending along an outer surface across the terminal channels that is configured to receive the rail of the housing when the carrier is loaded within the housing such that the rail extends across the terminal channels. The rail provides retention latch reinforcement for each of the retention latches.

DETAILED DESCRIPTION OF THE INVENTION

Figure 1:
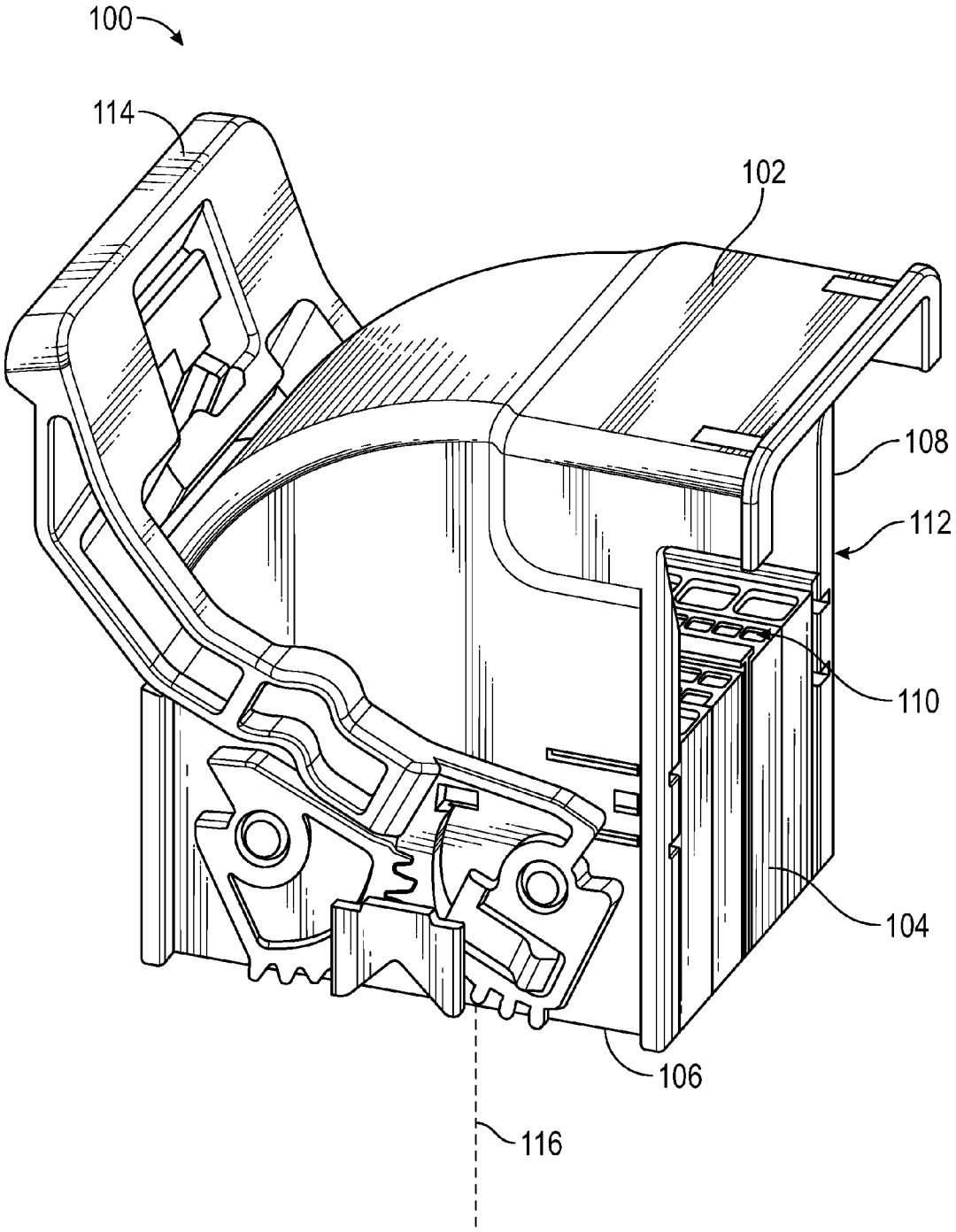
FIG. 1 is a perspective view of an electrical connector formed in accordance with an exemplary embodiment.

FIG. 1 is a perspective view of an electrical connector 100 formed in accordance with an exemplary embodiment. The electrical connector 100 is configured to couple with a mating connector (not shown). The electrical connector 100 may, for example, be in the form of a plug connector configured to mate with a receptacle connector, as is well known in the art. Alternatively, the electrical connector 100 may be in the form of a receptacle connector configured to mate with a plug connector, or other types of connectors which are known in the industry. In the embodiment shown, the electrical connector 100 is a carrier-style connector having a housing 102 and carriers 104 that are received in the housing 102. Any number of carriers 104 may be held within the housing 102.

The housing 102 has a mating end 106 and a carrier receiving end 108. In the illustrated embodiment, the mating end 106 is oriented perpendicular to the carrier receiving end 108, however other orientations are possible in alternate embodiments. During assembly of the electrical connector 100, the carrier 104 is loaded into a chamber 110 within the housing 102 through an opening 112 at the carrier receiving end 108. The housing 102 surrounds at least a portion of the carrier 104. Optionally, multiple carriers 104 are received in the chamber 110 of the housing. The carrier 104 is configured to hold a plurality of terminals 212 (shown in FIG. 2) that mate with corresponding mating contacts (not shown) of a mating connector (not shown). As such, the carrier 104 is aligned within the chamber 110 so the terminals 212 are positioned proximate to the mating end 106 of the housing 102. The housing 102 at the mating end 106 may be designed to guide the mating contacts of the mating connector into engagement with corresponding terminals within the carrier. For example, the mating end 106 may include lead-in channels (not shown) that have chamfered surfaces that guide the mating contacts of the mating connector into the housing 102. The electrical connector 100 mates with the mating connector at the mating end 106 along a mating axis 116. The carriers 104 may be loaded into the carrier receiving end 108 in a direction generally perpendicular to the mating axis 116. Optionally, a lever arm 114 may be coupled along an outside of the housing 102, and used to facilitate mating between the electrical connector 100 and the mating connector.

Figure 2:
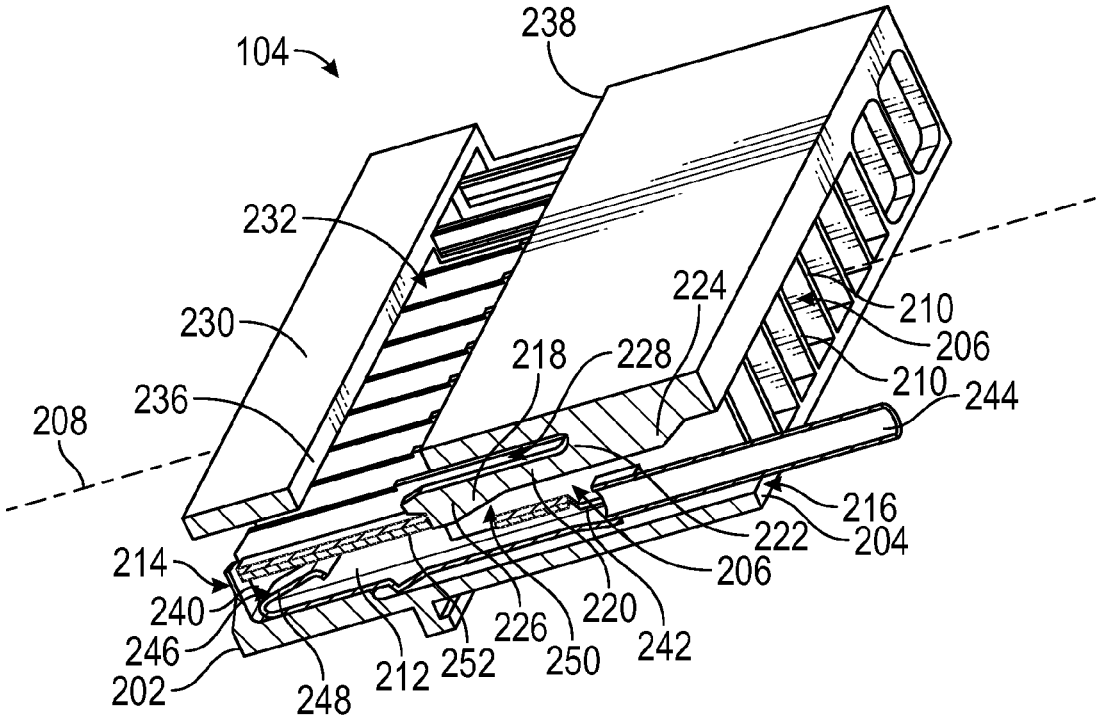
FIG. 2 is a partial sectional view of a carrier of the electrical connector of FIG. 1.

The terminals 212 in the carrier 104 may be terminated to conductors, such as wires or cables 244 (shown in FIG. 2). For example, the terminals 212 and attached wires 244 may be part of a wire harness (not shown) having a plurality of wires bundled together. When the terminals 212 are loaded in the carrier 104 within the housing 102, the wires 244 of the wire harness may extend from the opening 112 at the carrier receiving end 108 of the housing 102 for termination at a distal end of the wires 244 to an electrical device. For example, the electrical connector 100 may be used in an automotive application as part of a rearview mirror. The housing 102 and carrier 104 may be positioned within the mirror and the wire harness may extend through a mounting post that is used to attach the rearview mirror to a windshield. This rearview mirror application is merely an exemplary use, and the electrical connector 100 may be used in various other applications other than rearview mirrors, automotive or not.

FIG. 2 is a partial sectional view of the carrier 104 of the electrical connector 100 of FIG. 1. The carrier 104 includes a front 202 and a rear 204, and a plurality of terminal channels 206 extending along terminal axes 208 between the front 202 and the rear 204 along a width of the carrier 104. The terminal axes 208 may be oriented parallel to the mating axis 116 (shown in FIG. 1). Within the carrier 104, the terminal channels 206 are separated from one another by interior walls 210. In an exemplary embodiment, the carrier 104 is manufactured from a dielectric material, such as a plastic.

The terminal channels 206 are configured to receive corresponding terminals 212 therein. Front openings 214 of the terminal channels 206 are arranged in a predetermined pattern to allow the terminals 212 to mate with the mating contacts (not shown) carried by the mating connector (not shown). The terminal channels 206 also include rear openings 216 at the rear 204 of the carrier 104 which allow the terminals 212 to be inserted into the carrier 104.

The carrier 104 has retention latches 218 extending into the terminal channels 206. The retention latches 218 are configured to engage the corresponding terminals 212 to secure the terminals 212 in the terminal channels 206. In an exemplary embodiment, each terminal channel 206 has one retention latch 218. The retention latch 218 includes an arm or beam 220 extending generally longitudinally within a respective channel 206. The beam 220 is cantilevered and connected at a rear end 222 to the carrier 104 at an inner surface 224 of the channel 206. The beam 220 includes a free standing end 226 which can be pivoted or deflected outwardly in the channel 206 to allow a terminal 212 to be inserted into the channel 206. A space 228 defined between the cantilevered beam 220 and an outer surface 230 of the carrier 104 allows the beam 220 to deflect outwards. The retention latches 218 may be deflectable, but biased towards the interior of the terminal channels 206. For example, once a terminal 212 that causes the beam 220 to deflect outwards is removed or is fully loaded into the terminal channel 206, the beam 220 pivots back towards the interior of the terminal channel 206.

The retention latches 218 may be arranged in essentially the same relative position in each adjacent terminal channel 206 of the carrier 104. For example, the retention latches 218 may all extend towards the front 202 of the carrier 104 with the free standing end 226 closer to the front 202 than the rear 204. Additionally, the retention latches 218 may be connected to the inner surface 224 at a top of each channel 206 at generally the same locations along the length of the channels 206. Alternatively, the retention latches 218 may extend from the inner surface 224 along a bottom of the channels 206. The retention latches 218, in an alternative embodiment, may be offset from one another along the length of the channels 206.

In an exemplary embodiment, the carrier 104 includes a track 232 that extends along the width of the carrier 104. The track 232 may include a groove that is defined in the outer surface 230 of the carrier 104, such as an outer top surface or an outer bottom surface. In an exemplary embodiment, the track 232 is proximate to the retention latch 212. The track 232 extends across the terminal channels 206. For example, the track 232 may be oriented perpendicularly to the terminal channel axes 208. In an exemplary embodiment, the track 232 includes a groove in the outer surface 230 that extends through the inner surface 224 and into the terminal channels 206 between the interior walls 210 that define the channels 206. As such, the groove of the track 232 provides access to the terminal channels 206 from above (or below). The groove of the track 232 is defined to the front and rear by first and second edges 236, 238, respectively, of the outer surface 230, and to the interior (e.g., bottom) by the interior walls 210. In an exemplary embodiment, the track 232 is positioned between the front 202 and the rear 204 of the carrier 104 such that the free standing ends 226 of the retention beams 220 are located at least partially within the boundaries of the groove (although interior of the outer surface 230). Therefore, if one or more of the retention beams 220 are deflected outward of the channels 206, at least part of the free standing end 226 of the beam(s) 220 may extend into the groove of the track 232.

The terminals 212 include a mating end 240 and a wire terminating end 242. The mating end 240 is configured to be mated to a corresponding contact (not shown) of a mating connector (not shown). The wire terminating end 242 is configured to be terminated to an end of a conductor, such as a wire or a cable 244. In the illustrated embodiment, the terminal 212 is crimped to the wire 244. The terminal 212 may be terminated to the wire 244 by other means in alternative embodiments, such as by an insulation displacement connection, soldering, and the like. The wire 244 may extend from the rear opening 216 of the carrier 104. Although only a single terminal 212 terminated to a wire 244 is shown in FIG. 2, the carrier 104 is designed with multiple channels 206 in order to load a plurality of terminals 212 within the carrier 104 at one time.

The mating end 240 of the terminal 212 includes a socket 246 that is configured to receive the mating contact (not shown). The socket 246 optionally may be box-shaped. The socket 246 may be formed by stamping and forming the terminal 212. The terminal 212 includes a spring finger 248 extending into the socket 246. The spring finger 248 is configured to engage the mating contact, such as a pin of the mating contact, when the mating contact is loaded into the socket 246. For example, the pin of the mating contact extends into the socket 246 and engages the spring finger 248 to electrically connect the terminal 212 to the mating contact. In an exemplary embodiment, the terminal 212 includes a latch opening 250 in an upper surface 252 of the terminal. The latch opening 250 is configured to receive the corresponding retention latch 218 for securing the terminal 212 in the terminal channel 206. In an alternative embodiment, the latch opening 250 may be in a lower or bottom surface of the terminal 212 if the corresponding retention latch 218 is located below the terminal 212.

Figure 3:
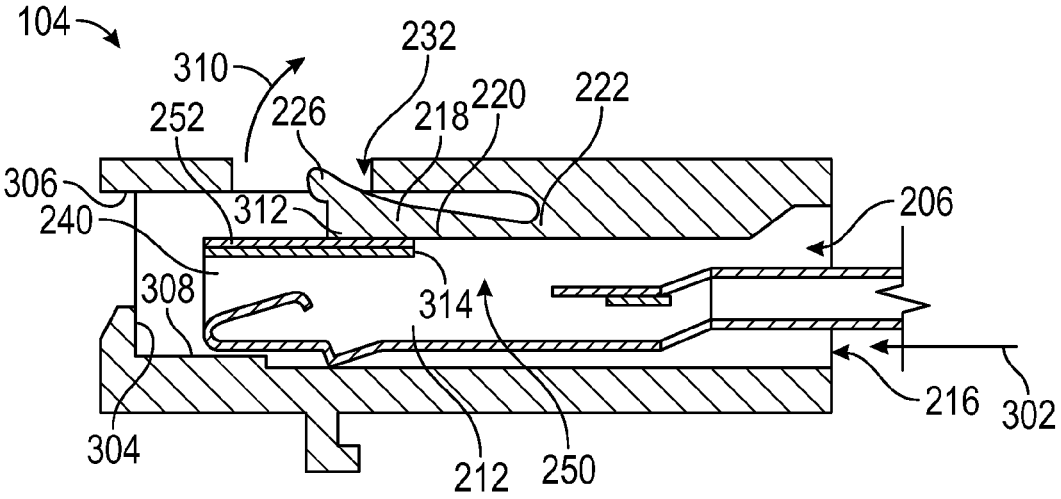
FIG. 3 is a partial sectional view of the electrical connector of FIG. 1.

FIG. 3 is a partial sectional view of the carrier 104 of the electrical connector 100 of FIG. 1. In FIG. 3, the terminal 212 is at an intermediate location within the terminal channel 206, which may occur if the terminal 212 is being loaded or unloaded into the channel 206, or is not loaded to the correct depth. The terminal 212 is loaded into the terminal channel 206 through the rear opening 216 along a loading direction 302. The terminal 212 is moved in the loading direction 302 until the mating end 240 of the terminal 212 engages a side wall 304, which indicates that the terminal 212 has reached a fully loaded position within the channel 206. The side wall 304, in addition to an upper wall 306 and a lower wall 308, may define a cradle that engages the mating end 240 and limits or restricts up and down and side to side movement of the terminal 212 within the channel 206. When the mating end 240 of the terminal 212 is within the cradle, the socket 246 aligns with the lead-in channel (not shown) on the mating end 106 (shown in FIG. 1) of the housing 102 (shown in FIG. 1) to receive the mating contacts therethrough.

As the terminal 212 is advanced in the loading direction 302 prior to reaching the fully loaded position, the terminal 212 deflects the retention latch 218 outward. For example, as the mating end 240 of the terminal 212 moves past the beam 220 of the retention latch 218, the upper surface 252 of the terminal 212 contacts the beam 220 and forces the beam 220 to pivot along the connected rear end 222 in the pivot direction 310. In an exemplary embodiment, at least part of the free standing end 226 of the beam 220 deflects out of the channel 206 and into the groove of the track 232.

Once the terminal 212 progresses to the point that the upper surface 252 moves beyond the free standing end 226 of the retention latch 218 and the free standing end 226 is exposed to the latch opening 250, the deflecting force on the beam 220 is removed. The beam 220 springs inwardly because the beam 220 is biased towards the channel 206. At least a portion of the retention latch 218 is received into the latch opening 250 of the terminal 212. For example, the free standing end 226 of the beam 220 includes a locking surface 312 that is received in the latch opening 250. When the terminal 212 reaches the fully loaded position within the channel 206, the retention latch 218 is not deflected outward and the locking surface 312 of the retention latch 218 is received in the latch opening 250. In an exemplary embodiment, when the retention latch 218 is not deflected outward by the upper surface 252, no part of the retention latch 218 extends into the groove of the track 232. Therefore, when the terminal 212 is in the fully loaded position within the channel 206, no part of the retention latch 218 extends into the groove of the track 232. FIG. 2 shows the terminal 212 in the fully loaded position within the channel 206. As shown in FIG. 3, however, when the terminal 212 is not fully loaded, at least part of the retention latch 218 protrudes into the track 232 as described above.

The retention latch 218 limits rearward movement of the terminal 212 out of the terminal channel 206 when the terminal 212 is fully loaded within the channel 206. The locking surface 312 at the free standing end 226 engages an edge 314 of the upper surface 252 and blocks rearward movement of the terminal 212 relative to the terminal channel 206. The terminal 212 is also blocked from further forward movement by the side wall 304 of the cradle of the carrier 104. If the terminal 212 is not loaded fully into the terminal channel, the retention latch 218 is not received in the latch opening 250. Instead, the retention latch 218 is deflected outward and contacts the upper surface 252. In this deflected position, the locking surface 312 of the retention latch 218 does not engage the edge 314, so the retention latch 218 does not significantly block rearward movement of the terminal 212.

Figure 4:
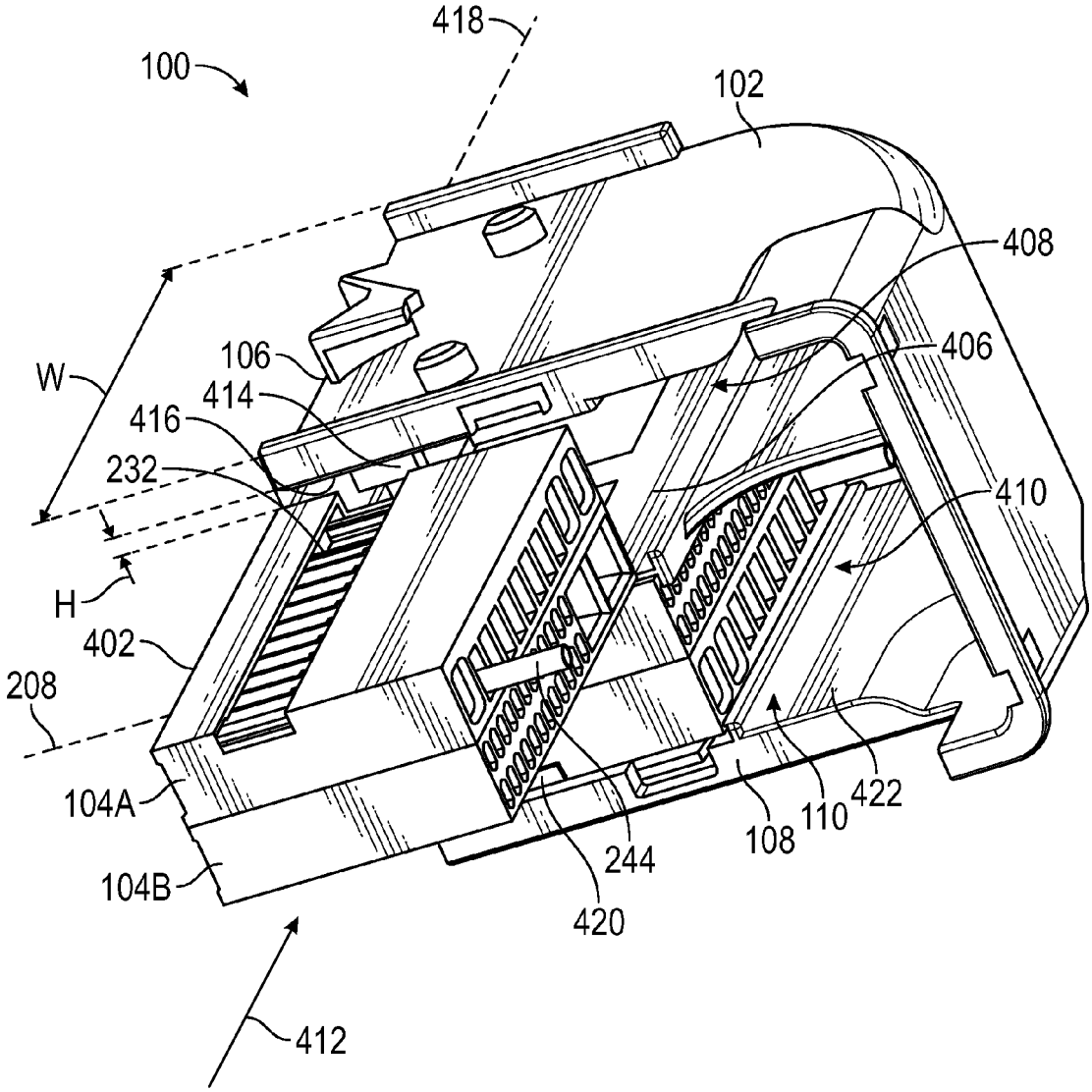
FIG. 4 is a partially exploded view of the electrical connector of FIG. 1.

FIG. 4 is a partially exploded view of the electrical connector 100 of FIG. 1. In FIG. 4, a carrier assembly 402 is poised for loading into the housing 102. The carrier assembly 402 includes a first carrier 104A coupled to a second carrier 104B adjacent the first carrier 104A. For example, the second carrier 104B may be coupled directly below the first carrier 104A. As shown in FIG. 4, the carrier 104A is housing a terminal 212 (shown in FIG. 2) that is terminated to a wire 244. Both carriers 104A and 104B are configured to receive a plurality of terminals. The carrier assembly 402 is received in the chamber 110 through the carrier receiving end 108 of the housing 102. The carrier receiving end 108 may be adjacent to the mating end 106 in an exemplary embodiment.

The housing 102 is manufactured from a dielectric material, such as a plastic material. The housing includes a rail 414 that extends from the carrier receiving end 108 into the chamber 110 along a longitudinal axis 418. In an exemplary embodiment, the rail 414 stretches the width W of the housing 102. The rail 414 may protrude from an inner wall 416 of the housing 102 a height H towards the opposite side of the housing 102. Optionally, the housing 102 may include at least two rails that are located on different inner walls. For example, as shown in FIG. 4, the rail 414 is located on the inner wall 416, and another rail 420 is located on another inner wall 422 that is opposite the inner wall 416.

The housing 102 may include one or more dividing walls that split the chamber 110 into sub-chambers. For example, as shown in FIG. 4, the housing 102 includes an intermediate wall 406 that divides the chamber 110 into a first sub-chamber 408 and a second sub-chamber 410. The non-loaded carrier assembly 402 is poised for loading into the first sub-chamber 408, and another carrier assembly 404 is fully loaded within the second sub-chamber 410. The intermediate wall 406 also may be used to guide the carrier assemblies 402, 404 into the housing 102. The housing 102 may be configured to receive more or less than the two carrier assembles 402, 404 shown in FIG. 4. Optionally, one or more individual carriers 104 may be loaded into the housing 102 instead of carrier assemblies. For simplicity, however, the description of FIG. 4 refers to the loading of the carrier assembly 402.

To assemble the electrical connector 100, once one or more terminals 212 (shown in FIG. 2) are loaded into the carrier assembly 402, the carrier assembly 402 is loaded into the first sub-chamber 408 of the housing 102. The carrier assembly 402 is advanced in a loading direction 412. In an exemplary embodiment, the loading direction 412 is perpendicular to the terminal channel axes 208 of the carrier 104. The loading direction 412 may also be perpendicular to the mating axis 116 (shown in FIG. 1) between the electrical connector 100 and the mating connector (not shown). In an exemplary embodiment, the loading direction 412 is parallel to a longitudinal axis 418 of the rail 414 of the housing 102. As the carrier assembly 402 is loaded, the rail 414 aligns with the track 232 of the carrier 104.

Figure 5:
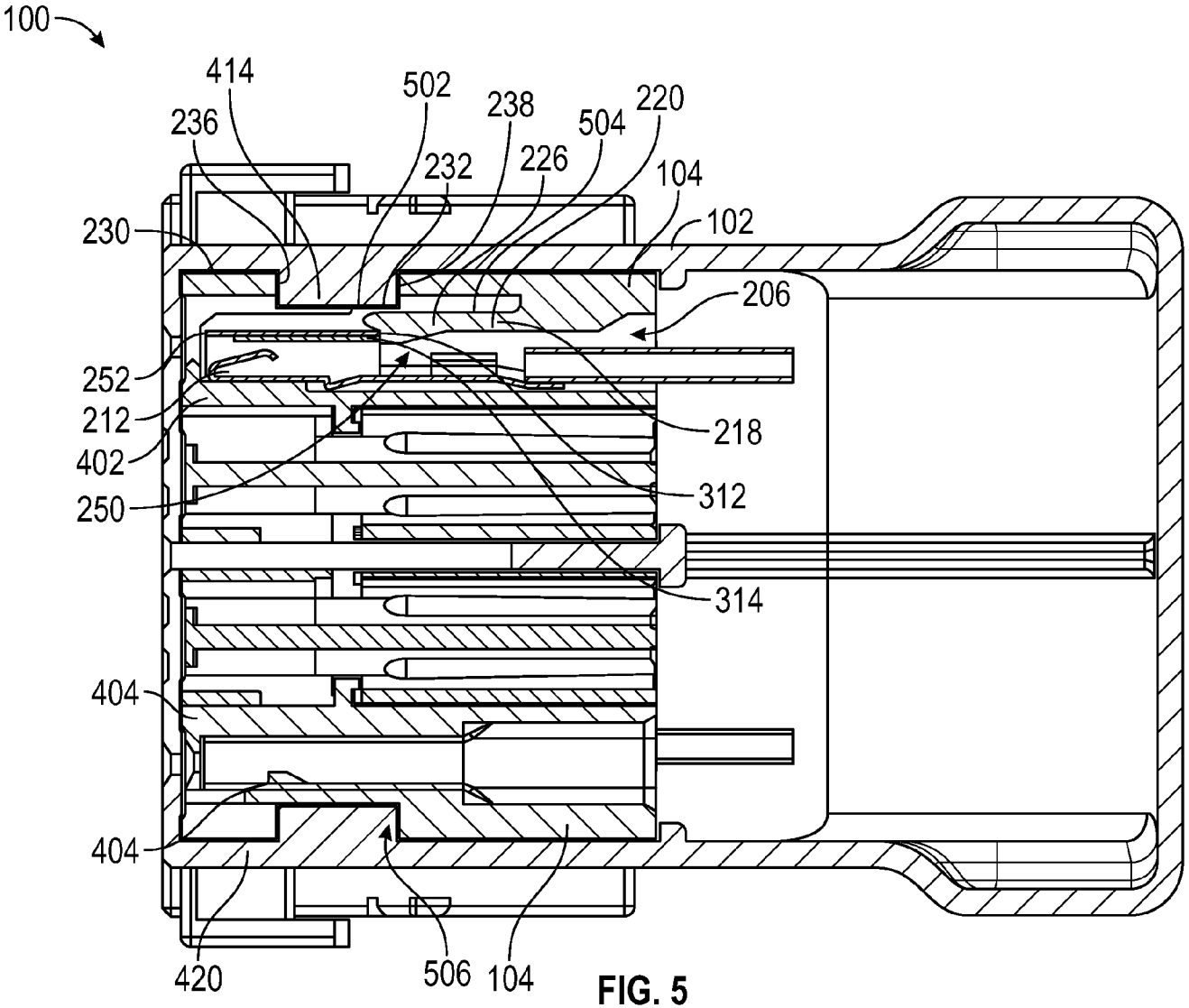
FIG. 5 is a partial sectional view of the electrical connector of FIG. 1.

FIG. 5 is a sectional view of the electrical connector 100 of FIG. 1. The cross section of FIG. 5 shows a loaded (or at least loading) condition of the carrier assembly 402 within the housing 102. As the carrier assembly 402 is loaded into the housing 102, the rail 414 extends into the groove of the track 232. The rail 414 may contact and slide along the first and/or second edges 236, 238 of the outer surface 230 of the carrier 104 and/or the bottom 502 of the groove, which is defined by tops of the interior walls 210 (shown in FIG. 2). Optionally, there may be a slight gap between the rail 414 and the edges 236, 238 and/or bottom 502 of the track 232 to reduce friction while the carrier assembly 402 is loading. The slight gap, if present, is smaller than the height that the retention latch 218 extends into the groove of the track 232 when deflected outward.

As shown in FIG. 5, the retention latch 218 or retention beam 220 is fully seated within the terminal channel 206 of the carrier 104. The free standing end 226 of the retention latch 218 or beam 220 is received in the latch opening 250 of the terminal 212, so the free standing end 226 is not deflected outward into the groove of the track 232. Since the retention latch 218 does not extend into the groove, the carrier assembly 402 may be inserted into the housing 102 by advancing the carrier assembly 402 in the loading direction 412 (shown in FIG. 4). As the carrier assembly 402 is advanced, the rail 414 extends into the groove of the track 232 across each of the terminal channels 206 of the carrier 104. The rail 414 within the groove is disposed proximate to an outer side 504 of the retention latch 218, at least near the free standing end 226 of the retention latch 218. In the illustrated embodiment, the electrical connector 100 also includes the rail 420, which is received in a groove 506 of the lower carrier 104 of the carrier assembly 404.

Figure 6:
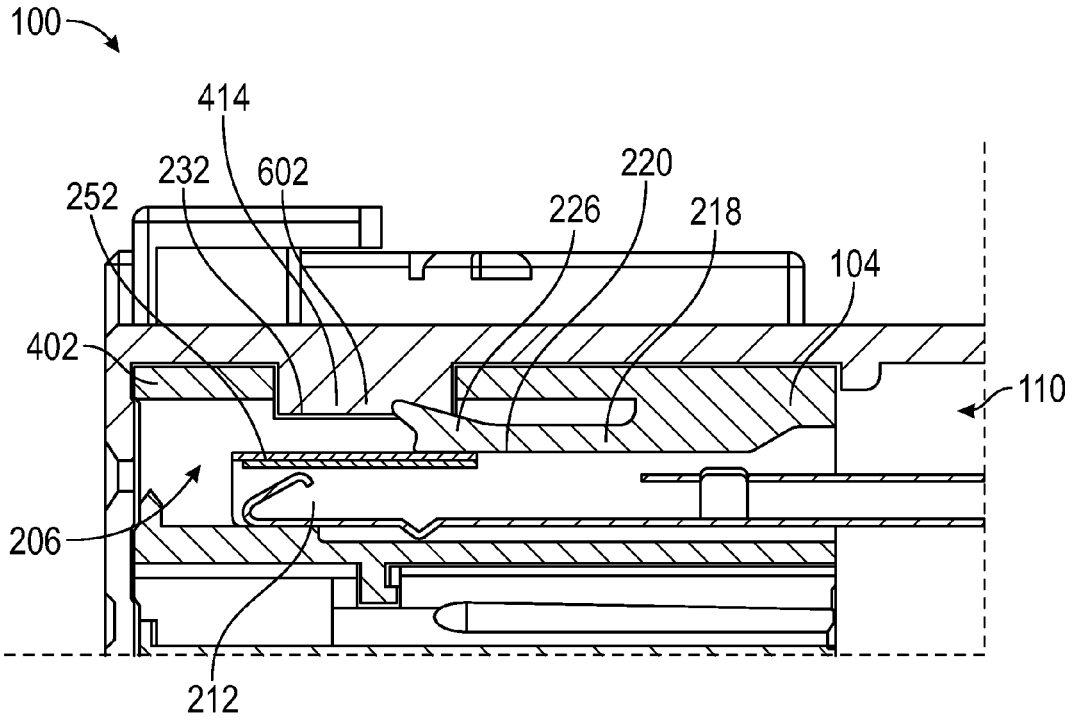
FIG. 6 is a partial sectional view of the electrical connector of FIG. 1.

FIG. 6 is a partial sectional view of the electrical connector 100 of FIG. 1. In FIG. 6, the carrier assembly 402 is not fully loaded within the housing 102. For example, the carrier assembly 402 may be at an intermediate loading position. Also as shown in FIG. 6, the terminal 212 is not fully loaded or seated within the terminal channel 206, so the retention latch 218 or beam 220 is deflected outward by the upper surface 252 of the terminal 212. The retention latch 218 is deflected outward such that the free standing end 226 protrudes into the groove of the track 232.

As the carrier assembly 402 is loaded into the chamber 110 of the housing 102 and the rail 414 is received in the track 232, the upward-deflected retention latch 218 interferes with the rail 414. For example, since the free standing end 226 protrudes into the groove, the exterior surface 602 of the rail 414 contacts the free standing end 226 as the carrier assembly 402 is moved in the loading direction 412 (shown in FIG. 4). The interference causes by the outward-deflected retention latch 218 or beam 220 prevents further movement of the carrier assembly 402 into the housing 102. Thus, the carrier assembly 402 is only allowed to be loaded to the point that the upward-deflected retention latch 218 contacts the outer surface 502 of the rail 414. For example, if multiple terminals 212 are not fully seated such that multiple retention latches 218 are outwardly-deflected, the carrier assembly 402 will be blocked by the first outwardly-deflected retention latch 218 that the rail 414 encounters. Therefore, the retention latches 218 or retention beams 220 of the carrier 104 and the rail 414 of the housing 102 act as terminal position assurance (TPA) elements. In order for the carrier 104 or carrier assembly 402 to be moved to the final loaded position within the housing 102, all of the terminals 212 must be fully seated in the terminal channels 206. If any of the terminals 212 are not properly seated, the carrier 104 or carrier assembly 402 may not be fully loaded into the housing 102. Thus, damage to the connectors and/or to the communicated electrical signals caused by mating two connectors having misaligned contacts is averted.

Referring back to FIG. 5, when the carrier 104 or carrier assembly 402 is fully loaded within the housing 102, the rail 414 may also serve to provide reinforcement to the retention latches 218 or beams 220 that retain the terminals 212 within the terminal channels 206. The rail 414 within the groove of the track 232 is disposed proximate to the outer sides 504 of the retention latches 218, and in an exemplary embodiment extends across all of the terminal channels 206. When a force is applied to a terminal 212 in a rearward direction, the upper surface 252 of the terminal 212 applies a force against the locking surface 312 of the retention latch 218 or beam 220. As a result of the amount of the force applied to the locking surface 312, the retention beam 220 may be inclined to buckle and/or flex outward, allowing the terminal 212 to slide past the retention latch 218 and out of the channel 206.

The rail 414, however, provides a ceiling that prevents the retention beam 220 from being over-flexed and/or over-stressed. For example, when a sufficient amount of force is applied, the beam 220 may begin to buckle and/or flex outward, but the outer side 504 of the beam 220 contacts the rail 414. The rail 414 prohibits the beam 220 from flexing outward of the channel 206 to a point that causes the locking surface 312 to disengage from the edge 314 of the upper surface 252 of the terminal 212. Thus, the rail 414 provides latch reinforcement. Since the rail 414 may extend across all of the terminal channels 206, the rail 414 provides latch reinforcement to all of the retention latches 218 or beams 220. The rail 414 protects the integrity of the retention latches 218, which may break due to buckling and/or over-flexing, and also prohibits unintentional removal of the terminals 212 from the carrier 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a mating end and a carrier receiving end, the housing including a rail that extends from the carrier receiving end into a chamber defined by the housing, and a carrier configured to be loaded into the chamber through the carrier receiving end, the carrier having terminal channels spaced along a width that are configured to receive terminals therein, the carrier having retention latches within the terminal channels configured to retain the terminals in the terminal channels, the carrier also having a groove extending along the width of the carrier that is configured to receive the rail of the housing when the carrier is loaded within the housing, wherein, when one of the terminals is not fully inserted within one of the terminal channels, the corresponding retention latch in the terminal channel is deflected outward at least partially into the groove such that the retention latch interferes with the rail of the housing and prevents further advancement of the carrier into the chamber.

2. The electrical connector of claim 1, wherein when the carrier is loaded fully into the housing, the rail prohibits the retention latches from deflecting outward of the terminal channel.

3. The electrical connector of claim 1, wherein the terminal includes a latch opening that is configured to receive a locking surface of the retention latch therein when the terminal is in a fully loaded position within the carrier, the locking surface configured to prevent rearward movement of the terminal relative to the terminal channel.

4. The electrical connector of claim 3, wherein when the locking surface of the retention latch is received in the latch opening of the terminal, the retention latch is not deflected into the groove and does not interfere with the rail of the housing, allowing the carrier to be advanced further into the chamber.

5. The electrical connector of claim 1, wherein the ten Anal channels are aligned along parallel terminal channel axes, and the groove extends perpendicular to the terminal channel axes.

6. The electrical connector of claim 5, wherein the carrier is loaded into the housing in a loading direction that is perpendicular to the terminal channel axes.

7. The electrical connector of claim 1, wherein the mating end of the housing is adjacent to the carrier receiving end that receives the carrier.

8. The electrical connector of claim 1, wherein the terminal includes a socket that aligns with a lead-in opening at the mating end of the housing.

9. The electrical connector of claim 1, wherein the terminals are terminated to wires of a wire harness.

10. The electrical connector of claim 1, wherein the housing includes at least two rails that are located on different inner walls, each rail configured to be received in a groove of a different carrier.

11. An electrical connector comprising:

a carrier having terminal channels spaced along a width of the carrier and a track on an outer surface of the carrier that extends along the width, the terminal channels configured to receive terminals therein for connecting to mating contacts of a mating connector, the carrier including retention beams mounted inward of the outer surface and extending into the terminal channels; and a housing that receives and at least partially surrounds the carrier, the housing including a rail that is received in the track of the carrier when the carrier is loaded into the housing;

wherein until a terminal that is being inserted into a corresponding terminal channel reaches a fully loaded position within the terminal channel, the terminal deflects the corresponding retention beam in the terminal channel outward at least partially into the track, which interferes with the rail of the housing and prevents further advancement of the carrier into the housing beyond the retention beam.

12. The electrical connector of claim 11, wherein the terminal includes a latch opening that is configured to receive a locking surface of the retention beam therein when the terminal is in the fully loaded position, the locking surface configured to engage an edge of the terminal to prevent rearward movement of the terminal relative to the terminal channel.

13. The electrical connector of claim 12, wherein the retention beam is biased towards the terminal channel, and when the locking surface of the retention beam is received in the latch opening of the terminal, the retention beam pivots toward the terminal channel and away from the track, allowing the carrier to be advanced further into the housing beyond the retention beam.

14. The electrical connector of claim 11, wherein when the carrier is loaded fully within the housing, the rail is located proximate to an outer side of the retention beams, and the rail prohibits the retention beams from deflecting outward of the terminal channels.

15. The electrical connector of claim 11, wherein the terminal channels are aligned along parallel terminal channel axes, and the track extends perpendicular to the terminal channel axes.

16. The electrical connector of claim 15, wherein the carrier is loaded into the housing in a loading direction that is perpendicular to the terminal channel axes.

17. An electrical connector comprising:

a housing having a mating end configured to interface with a mating connector and a carrier receiving end adjacent to the mating end, the housing including a rail protruding from an inner wall and extending from the carrier receiving end into a chamber defined by the housing; and a carrier having a front and a rear and defining multiple terminal channels between the front and the rear that are oriented along parallel terminal channel axes and configured to receive terminals therein, the carrier having retention latches configured to retain the terminals in the terminal channels, the carrier configured to be loaded into the chamber of the housing through the carrier receiving end in a loading direction that is perpendicular to the terminal channel axes such that the front of the carrier is proximate to the mating end of the housing, the carrier including a groove extending along an outer surface across the terminal channels that is configured to receive the rail of the housing when the carrier is loaded within the housing such that the rail extends across the terminal channels, the rail providing retention latch reinforcement for each of the retention latches.

18. The electrical connector of claim 17, wherein the retention latches of the carrier each have a locking surface that is received in a latch opening of the corresponding terminal and engages an edge of the terminal to prevent rearward movement of the terminal.

19. The electrical connector of claim 17, wherein if the terminals in the terminal channels are not in a fully loaded position, the corresponding retention latches are deflected outward at least partially into the groove and interfere with the rail when the carrier is advanced into the housing.

20. The electrical connector of claim 17, wherein the rail prohibits the retention latches from deflecting outward from the terminal channels, supporting retention of the terminals within the terminal channels.

* * * * *